US009802296B2

(12) United States Patent
Hielscher et al.

(10) Patent No.: US 9,802,296 B2
(45) Date of Patent: Oct. 31, 2017

(54) SCREWING DEVICE WITH ROTATABLE TOOLS

(71) Applicant: Dr. Hielscher GmbH, Teltow (DE)

(72) Inventors: Harald Hielscher, Stahnsdorf (DE); Holger Hielscher, Teltow (DE); Thomas Hielscher, Potsdam (DE)

(73) Assignee: DR. HIELSCHER GMBH, Teltow (DE)

( * ) Notice: Subject to any disclaimer, the term of this patent is extended or adjusted under 35 U.S.C. 154(b) by 329 days.

(21) Appl. No.: 14/640,754

(22) Filed: Mar. 6, 2015

(65) Prior Publication Data

US 2015/0273667 A1 Oct. 1, 2015

Related U.S. Application Data

(60) Provisional application No. 61/949,356, filed on Mar. 7, 2014.

(30) Foreign Application Priority Data

Mar. 7, 2014 (DE) ..... 10 2014 103 052

(51) Int. Cl.

| | |
|---|---|
| ***B25B 17/00*** | (2006.01) |
| ***B25B 13/06*** | (2006.01) |
| ***B25B 13/48*** | (2006.01) |
| ***B25B 23/00*** | (2006.01) |
| ***B25B 13/08*** | (2006.01) |
| ***B25B 17/02*** | (2006.01) |

(52) U.S. Cl.
CPC ..... *B25B 13/48* (2013.01); *B25B 13/08* (2013.01); *B25B 17/02* (2013.01)

(58) Field of Classification Search
CPC ..... B25B 17/00; B25B 17/02; B25B 23/0085; B25B 21/002; B25B 13/48; B25B 13/08; B25B 13/488
See application file for complete search history.

(56) References Cited

U.S. PATENT DOCUMENTS

| | | | | |
|---|---|---|---|---|
| 4,914,987 | A * | 4/1990 | Isler | B25B 13/48 81/56 |
| 4,928,559 | A * | 5/1990 | Stielow | B25B 13/463 81/124.2 |
| 5,460,062 | A * | 10/1995 | Wilson, Jr. | B25B 13/48 81/56 |
| 6,308,593 | B1 * | 10/2001 | Shibayama | B25B 17/00 81/57.4 |
| 7,311,025 | B1 * | 12/2007 | Wilson, Jr. | B25B 13/481 81/429 |
| 7,513,179 | B2 * | 4/2009 | Wilson, Jr. | B25B 13/481 81/429 |

(Continued)

FOREIGN PATENT DOCUMENTS

DE 2914422 10/1980

*Primary Examiner* — David B Thomas
(74) *Attorney, Agent, or Firm* — Fox Rothschild LLP

(57) ABSTRACT

The invention relates to a screwing device (1) with two tools (2, 3) for producing or releasing a screw connection between two fastening elements (10, 11). For a simple and compact structure of the screwing device (1), the invention provides that the tools (2, 3) are during the operation of the screwing device (1) connected to one another for rotation about common rotation axes (D1, D2).

10 Claims, 3 Drawing Sheets

(56) References Cited

U.S. PATENT DOCUMENTS

| | | | | |
|---|---|---|---|---|
| 7,631,580 | B2 * | 12/2009 | Lu | B25B 13/488 81/56 |
| 7,942,084 | B2 * | 5/2011 | Wilson, Jr. | B25B 13/481 81/429 |
| 8,261,454 | B2 * | 9/2012 | Wilson, Jr. | B21D 7/04 30/95 |
| 8,322,255 | B1 * | 12/2012 | Jordan | B25B 17/00 81/476 |
| 8,353,229 | B1 * | 1/2013 | Muhareb | B25B 13/08 81/55 |
| 8,438,955 | B2 * | 5/2013 | Wilson, Jr. | B25B 21/002 81/185.2 |

* cited by examiner

SCREWING DEVICE WITH ROTATABLE TOOLS

CROSS REFERENCE TO RELATED APPLICATIONS

This Application claims priority to and the benefit of U.S. Provisional Application No. 61/949,356 filed Mar. 7, 2014, and German Application No. 102014103052.4 filed Mar. 7, 2014, both of which are hereby incorporated herein by reference in their entireties.

FIELD OF THE INVENTION

The invention relates generally to a screwing device with at least two tools, with each tool having a receptacle for a screwable fastening element. And more specifically to a screwing device, wherein during the operation of the screwing device, the receptacles are arranged with mutually aligned axes of rotation and are spaced apart from one another along the axes of rotation.

BACKGROUND OF THE INVENTION

Screwing devices of the aforementioned type are generally known. These are generally used to rotate two fastening elements, for example screws or nuts, with respect to one another so that the fastening elements can be screwed together or a screw connection between the fastening elements can be released. The tools for tightening or releasing the connection can also be used to rotate with respect to each other elements, such as closures, for example a bayonet closure, that can be connected or released by twisting.

For forming a positive connection with the receptacles, the fastening elements have corresponding outer surfaces with a for example complementary shape. For example, the receptacles are jaw-shaped and can be attached on the fastening elements transversely to the direction of rotation of the fastening elements. Alternatively or additionally, the receptacles can be designed to twist the fastening elements while these are frictionally held, for example by compression.

A screwing device for screwing two fastening elements together is disclosed for example in DE 29 14 422 C2. One of the receptacles of this screwing device is supported in the tool for rotation with respect to the other of the receptacles. However, this conventional screwing device is mechanically complex and cannot be easily adapted to fastening elements having differently shaped outer surfaces. Furthermore, the screwing device is large and therefore difficult to handle.

BRIEF SUMMARY OF THE INVENTION

In order to overcome one or more of the above-mentioned problems, various embodiments of the present invention provide a screwing device that is easier to handle.

According to various embodiments, during the operation of the screwing device, the tools are connected to each other while being rotatable about the axis of rotation.

The tools can be designed to be simpler and more compact because the receptacles need no longer be accommodated in one of the tools for rotation. It is sufficient for the receptacles to be secured in the tool and the respective tool to be rotatable together with the receptacle, in order to tighten the fastening element or to release the screw connection.

The solution according to the invention can be further improved by various embodiments that have separate advantages and that, unless stated otherwise, can be freely combined with one another. These embodiments and their associated advantages will be discussed below.

For example, the screwing device may have a gear that rotatably interconnects the tools to each other. A gear firmly interconnects at least the at least two tools with low backlash so that tightening forces introduced into one of the tools can be introduced into the fastening elements via the receptacles of both tools without or with only a small loss of force. If more than two tools are provided, then all tools can be interconnected for rotation via the gears. Alternatively, some and in particular all tools, except for the two tools, can be rigidly connected to the two tools that are coupled together via the gear.

In order to enable an operator to tighten and/or release the fastening elements by applying large torques, the gear may have a gear ratio of, for example, between 1:2 and 1:1000 and, for example, 1:3, 1:4, 1:5 or up to 1:10 or even greater.

The gear may, for example, be a toothed gear, wherein a respective gear wheel of the gear is associated with at least two of the tools. Alternatively, each of the tools may have a gear wheel of the gear and be motion-coupled to the other tools. Toothed gears permit a compact design of the gear so that the footprint of the screwing device does not needlessly increase. For example, the toothed gear may be a planetary gear train.

The gear may have a drive gear wheel and a driven gear wheel which are motion-coupled, wherein the drive gear wheel is rotatably mounted in one of the tools and the driven gear wheel is attached to another of the tools. A force for screwing the fastening elements together or for releasing a screw connection between two fastening elements can be introduced in the drive gear wheel. For example, an operator can introduce the force mechanically in the drive gear wheel. Teeth of the drive gear wheel engage during the operation of screwing device with the toothing of the driven gear wheel and thus transfer the force applied by the operator from one of the tools to the other of the tools. If the screwing device includes more than two tools, one of the tools may be provided with the drive gear wheel while the other tools are provided with a respective driven gear wheel. For example, the drive gear wheel extends parallel to the axes of rotation of the tools sufficiently far so that it can be brought into engagement with the driven gear wheels of all tools having such driven gear wheels.

In the simplest case, the gear may be composed of the drive gear wheel and the driven gear wheel or several driven gear wheels, so that the gear can be built constructed with few parts.

Due to the gear, the at least two tools rotate in different directions, so that the fastening elements can be screwed together efficiently or their screw connection can be efficiently released. If the screwing device includes more than two tools, then at least one of the tools may be rotatable in one direction while the remaining tools may be rotatable in another direction, wherein the directions are preferably opposite directions. For example, a contiguous group of tools in contact with each other may be rotatable in one direction while another contiguous group of tools may be rotatable in the other direction.

An axis of rotation of the drive gear wheel is preferably aligned parallel to and spaced from the axes of rotation of the receptacles. Forces urging the drive gear wheel to move parallel to the axis of rotation upon application of an operating force, which occur for example in bevel gears with mutually tilted axes of rotation, therefore do not occur.

The distance between the axis of rotation of the drive gear wheel and the axes of rotation further represents a force arm of a lever which further simplifies tightening or releasing a screw connection.

An axis of rotation of the driven gear wheel(s) is preferably aligned with the axes of rotation of the receptacles. Consequently, the axes of rotation of the tools can be brought into overlapping engagement with little mechanical effort.

In a particularly preferred and space-saving embodiment of the screwing device, the at least one driven gear wheel is ring gear. The ring gear is ring-shaped and has the teeth on its inner side. The drive gear wheel may thus be located on the inside of the ring gear, so that the screwing device may be constructed transverse to the axis of rotation so as to save space. Furthermore, the screwing device may have a larger diameter transverse to the axis of rotation, thus allowing a larger gear ratio of the gear. Alternatively, the drive gear wheel and the at least one driven gear wheel may be designed as normal gear wheels arranged next to each other transversely to the direction of rotation.

For ease of use of the screwing device, the drive gear wheel may have a coupling member for coupling to an operating element. The operating element is for example a torque wrench that can be coupled with the coupling member parallel to the axes of rotation. When the torque wrench is coupled to the coupling member, a torque that is smaller than an allowable maximum value can be introduced by way of the torque wrench into the drive gear wheel and therefrom to the driven gear wheel. A screw connection with high screwing torques and a low operating force can thus be safely and easily formed.

The tools may be separable from each other along the axis of rotation. For example, the tools may be moved away from each other along the axis of rotation. The drive gear wheels and the driven gear wheels are thereby separated from each other. In particular, the tools can be easily moved away from each other when the axes of rotation of the drive gear wheels and the driven gear wheels are parallel to each other. For example, at least one of the tools may be replaced by another tool with a differently sized gear wheel in order to adapt the gear ratio of the gear to the screw connection to be formed or released.

The screwing device may include at least two connecting elements, such as tool components, which can be attached to a respective one of the receptacles and which, when fastened to the receptacle, are prevented from rotating about the axis of rotation the relative to the housing having the receptacle. The connecting elements are designed, for example, so as to be able to positively or frictionally hold and twist fastening elements that cannot be retained by the receptacles.

In other words, the receptacles can thus positively or frictionally hold a respective one of the connecting elements or a respective one of the fastening elements. The connecting elements can in each case positively and/or frictionally hold one of the fastening elements.

At least one of the tools may be provided with a receptacle able to frictionally or positively hold the fastening element or the connecting element. At least one of the remaining tools may be provided with a receptacle able to hold the fastening element or the connecting element in a different way as the at least one tool, i.e. frictionally or positively. Alternatively, the receptacles of all tools may be designed to hold the fastening element or the connecting element in the same manner, i.e. positively or frictionally.

Likewise, at least one of the tools may be provided with a connecting element able to hold the fastening element frictionally or positively. At least one of the remaining tools may be provided with a connecting element able to hold the fastening element in a different way as the at least one tool, i.e. positively or frictionally. Alternatively, the connecting elements of all the tools may be designed to hold the fastening element in the same manner, i.e. frictionally or positively.

Furthermore, connecting elements that are frictionally held by the receptacle may be designed to positively or frictionally hold the fastening element. Connecting elements that are positively held by the receptacle may also be designed to hold the fastening element positively or frictionally.

In particular, tools which are rotatable in one direction may be designed to hold the fastening element and/or the connecting element in the same manner, i.e. frictionally or positively, while tools which are rotatable in an opposite direction may be designed to hold the fastening element and/or the connecting element differently, i.e. positively or frictionally.

The rigid connection between the connecting elements and the respective housing allows the tightening forces to be efficiently transmitted from the tool to the respective fastening element. The connecting elements may be used as adapter elements so that fastening elements that do not fit the receptacles can be screwed together with the screwing device. The connecting elements may also be exchanged for connecting elements having different dimensions and connecting elements adapted to fastening elements and having, for example, other drive profiles, which enhances the flexibility of the screwing device.

The invention will now be described with reference to embodiments and to the appended drawings. The different features of the embodiments can be combined independent of one another, as was already discussed for the individual advantageous embodiments.

DETAILED DESCRIPTION OF THE INVENTION

Figure 1:
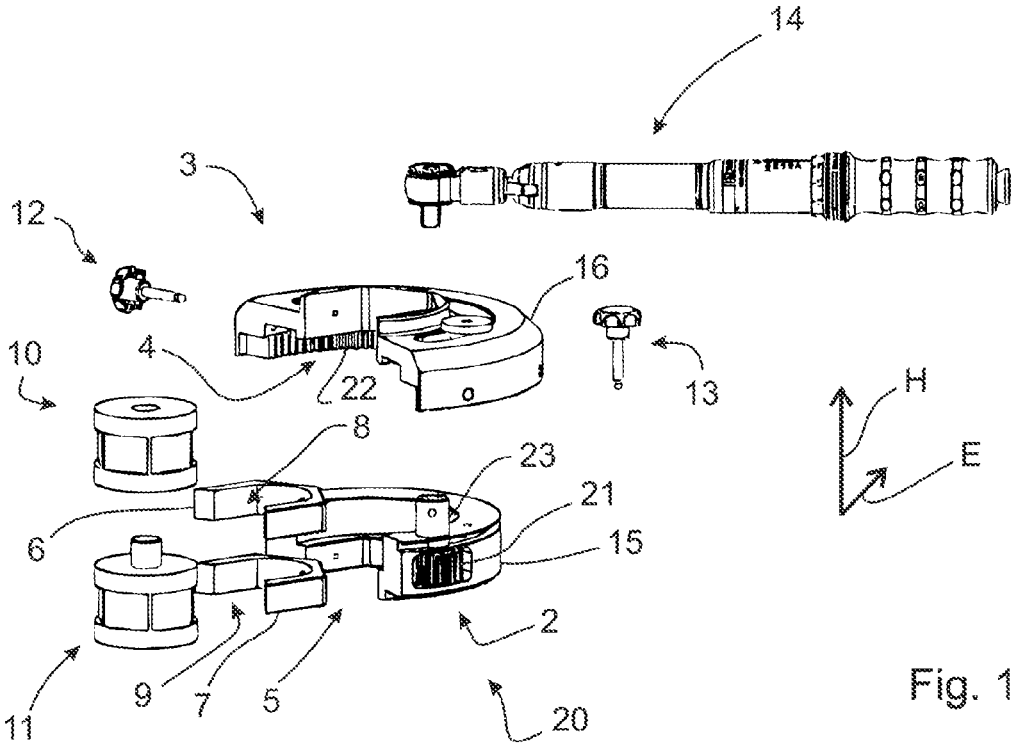
FIG. 1 a schematic exploded view of a first exemplary embodiment of the screwing device according to the invention.

FIG. 1 shows schematically the screwing device 1 according to the invention in a perspective exploded view. The screwing device 1 has two tools 2, 3, which are shown with a mutual spacing along a height direction H of the screwing device 1.

Each of the tools 2, 3 is designed with a receptacle 4, 5 for a fastening element 10, 11 and/or for a connecting element, which is exemplified as a tool component 6, 7. In the following, the connecting elements are also exemplified as tool components, wherein other connecting elements that are each capable of rotating, for example, one of the frictionally held fastening elements 10, 11 can be used instead of the tool components. The tool components 6, 7 can each be inserted and fastened in one of the receptacles 4, and 5. The receptacles 4, 5 may open, for example, in an insertion direction extending transversely to the height direction H, so that tool components 6, 7 can be inserted along the insertion direction E into a respective one of the receptacles 4, 5. The receptacles 4, 5 may hence be designed essentially U-shaped. Likewise, one of the fastening elements 10, 11 may be rotatable when positively and/or frictionally held by a respective one of the receptacles 4, 5.

To prevent rotation of the tool components 6, 7 about the height direction H in the receptacles 4, 5, the receptacle 4, 5 may have a polygonal cross section transversely to the height direction H while the tool components 6, 7 may be formed on their outer sides complementary to the polygonal cross-section. The cross-section of the receptacles 4, 5 is preferably adapted to a drive profile of one type of the fastening elements.

Inner sides 8, 9 of the receptacles 4, 5 and/or of the tool components 6, 7 are provided with tool surfaces having a cross-section transverse to the height direction H that is substantially complementary to a drive profile of fastening elements 10, 11 that can be screwed together with the screwing device 1. The fastening elements 10, 11 are provided, for example, with nut-shaped drive profiles and can be screwed together using the screwing device 1. Alternatively or additionally, a screw connection between the fastening elements 10, 11 and the screwing device 1 can be releasable.

The screwing device 1 can be used to screw together suitably shaped fastening elements even without the illustrated tool components 6, 7. The tool components 6, 7 can be used as needed and can be exchanged for tool components of different sizes in order to flexibly use the screwing device 1 with fastening elements having different dimensions and in particular different drive profiles.

The screwing device 1 is illustrated in one example with two safety elements 12, 13, which secure the relative position in an assembled state of the tools 2, 3. The safety elements 12, 13 are formed, for example, as safety pins that can be inserted through one of the tools 2, 3 into respective other tools 2, 3. The tools 2, 3 can for this purpose have suitably dimensioned and arranged openings.

For example, the openings can be formed transversely to the height direction H or along the height direction H in order to prevent the tools 2, 3 from shifting relative to one another in the height direction H or transversely to the height direction H.

In addition, FIG. 1 shows an operating element 14 for operating the screwing device 1. The operating element 14 in this example is shown as a torque wrench.

Each of the tools 2, 3 is formed with a base body 15, 16. The base bodies 15, 16 may be formed as a housing of the tools 2, 3 and/or may have positioning or guide elements that can facilitate assembly of the tools 2, 3 or guide their rotational movement relative to each other. The receptacles 4, 5 may be formed through or molded into the base body 15, 16. Preferably, the base bodies 15, 16 can be handled as one piece or are even produced from one piece.

The screwing device 1 of the exemplary embodiment of FIG. 1 has a gear 20 that motion-couples the tools 2, 3 with one another during the operation of the screwing device 1. In particular, the gear moves the tools 2, 3 in opposition to each other about the vertical direction H in order to rotate the fastening elements 10, 11 relative to one another and thereby efficiently tightening and/or releasing them.

The gear 20 is preferably a toothed gear and in particular a planetary gear, with a drive gear wheel 21 and a driven gear wheel 22. The drive gear wheel 21 is in the embodiment of FIG. 1 associated with the height direction H of the tool 2 that is arranged in front of the tool 3. In particular, the drive gear wheel 21 is mounted for rotation eccentrically and on an edge of the tool 2, with an axis of rotation of the drive gear wheel 21 extending parallel to the height direction H.

The driven gear wheel 22 is, for example, associated with the tool 3, wherein an axis of rotation of the driven gear wheel 22 is also parallel to the height direction H. In particular, the gear may be composed of the drive gear wheel 21 and the driven gear wheel 22.

The base bodies 15, 16 cover the gear 20 in the assembled state of the tools 2, 3 in order to improve the operational safety of the screw connection and prevent foreign objects from entering the gear 20. The gear wheels 21, 22 can be rotatably mounted in or immovably attached to the base body 15, 16 of the respective tool 2, 3.

When the tools 2, 3 are moved along the height direction H towards each other and brought together at the screwing device 1, the drive gear wheel 21 and the driven gear wheel 22 engage with each other and thus transmit movements between the tools 2, 3.

For example, the drive gear wheel 21 may have a coupling member 23 coupling of the drive gear wheel 21 with the operating element 14. For this purpose, the operating element 14 may be formed, for example, as a socket wrench while the coupling member 23 may be formed with a receptacle for the socket wrench which is at least partially shaped complementarily to the socket wrench.

The drive gear wheel 21 can be rotated with the operating element 14. The drive gear wheel 21 transmits to the driven gear wheel 22 and thus to the tool 3 an operating force introduced into the drive gear wheel 21. The operating force causes the tools 2, 3 to be rotated relative to one another about the vertical direction H. When the axes of rotation of the tools 2, 3 or receptacles 4, 5 are in mutual alignment and run parallel to the height direction H in the assembled state of the screwing device 1, the fastening elements 10, 11 can be readily screwed together or unscrewed by introducing the operating force into the coupling member 23.

The screwing device 1 of the exemplary embodiment of FIG. 1 is illustrated with a driven gear wheel 22 exemplified as a ring gear. The driven gear wheel 22 depicted as a ring gear is shaped as a ring and has teeth on its inside.

Figure 2:
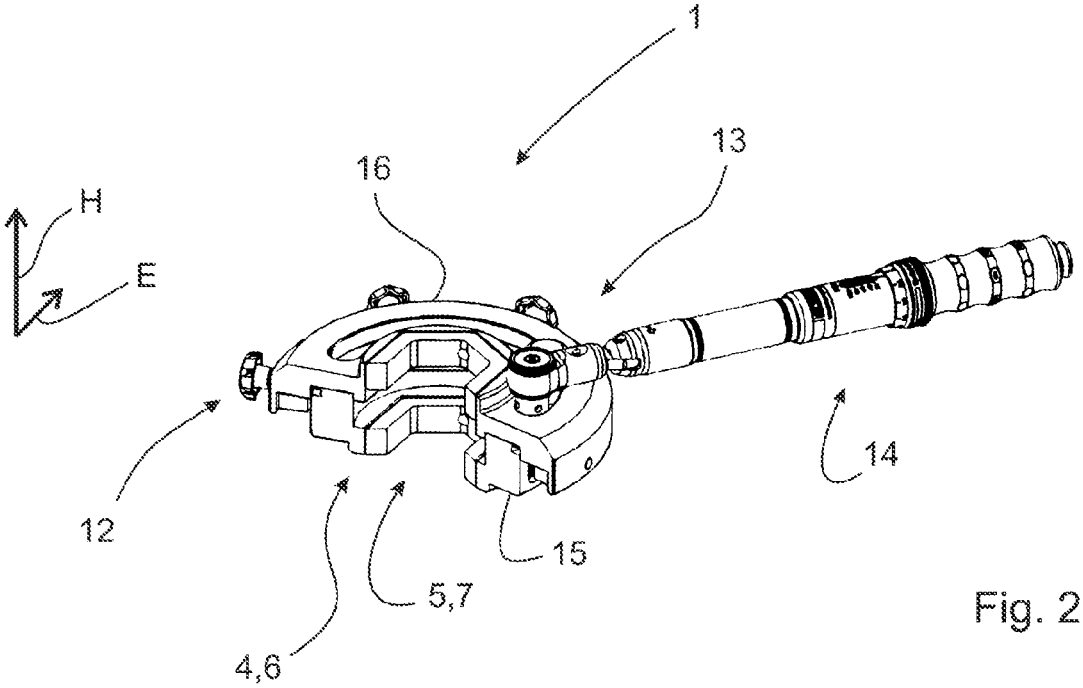
FIGS. 2 to 5 schematic perspective views of the screwing device of the exemplary embodiment of FIG. 1.

FIG. 2 shows the embodiment of FIG. 1 in a perspective view. The same reference numerals are used for elements that correspond in function and/or structure to the elements of FIG. 1.

The screwing device 1 is shown assembled in FIG. 2, wherein the tools 2, 3 are moved toward each other along the height direction H until the drive gear wheel 21 and the driven gear wheels 22 are in mutual engagement. Several safety elements 12, 13 prevent the tools 2, 3 from coming apart. The tool components 6, 7 are inserted into the receptacles 4, 5 in the insertion direction E. The receptacles 4, 5 and the tool components 6, 7 are spaced apart from each other along the height direction H to ensure that only one of the fastening elements 10, 11 is gripped by a respective one of the tool components 6, 7.

In the exemplary embodiment of FIG. 2, the operating element 14 is coupled with the coupling member 23, so that the drive gear wheel 21 can be rotated with the operating element 14. However, the coupling member 23 as well as the drive gear wheel 21 and the driven gear wheel 22 are obscured in the Figure by the base body 15, 16 and therefore not visible.

Figure 3:
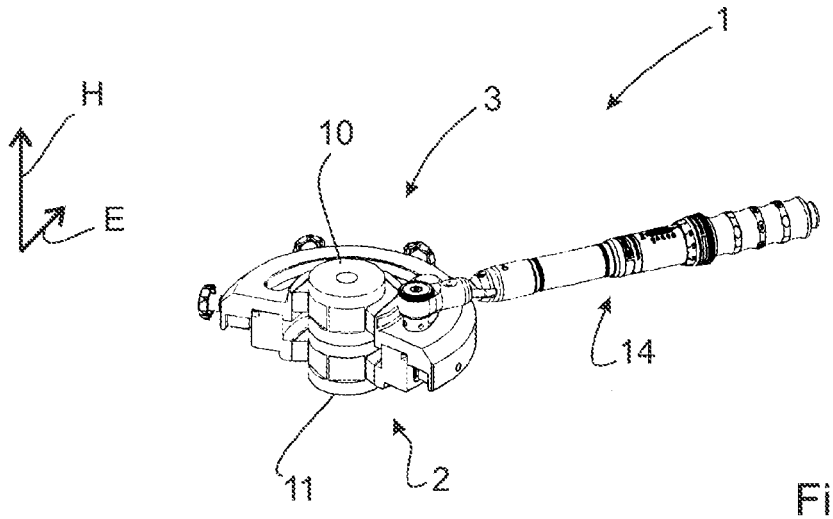

FIG. 3 shows the screwing device 1 of the exemplary embodiment of FIGS. 1 and 2 in a schematic perspective view and with two screwed-together fastening elements 10, 11. The same reference numerals are used for elements that correspond in function and/or structure to the elements of FIGS. 1 and 2.

In FIG. 3, the screwing device 1 is placed on the screwed-together fastening elements 10, 11 in opposition to the insertion direction E. The inner sides 8, 9 of the tool members 6, 7 having tool faces at least partially positively encompass the safety elements 10, 11 transversely to the direction of height H, so that rotation of the tools 2, 3 causes the fastening elements 10, 11 to also rotate.

Figure 4:
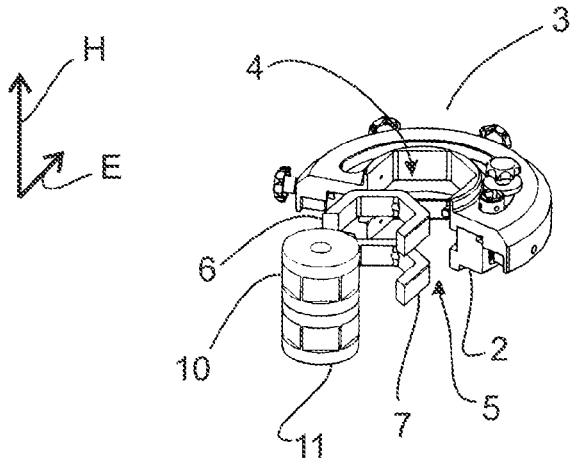

FIG. 4 schematically illustrates the screwing device 1 of the exemplary embodiment of FIGS. 1 to 3 in another perspective view. The same reference numerals are used for elements that correspond in function and/or structure to the elements of FIGS. 1 to 3.

In the FIG. 4, the operating element 14 is not shown. Furthermore, the tool components 6, 7 and the screwed-together fastening elements 10, 11 are moved out of the tools 2, 3, in opposition to the insertion direction E. The tool components 6, 7 and/or the screwed-together fastening elements 10, 11 can be inserted into the receptacles 4, 5 in the insertion direction E.

Figure 5:
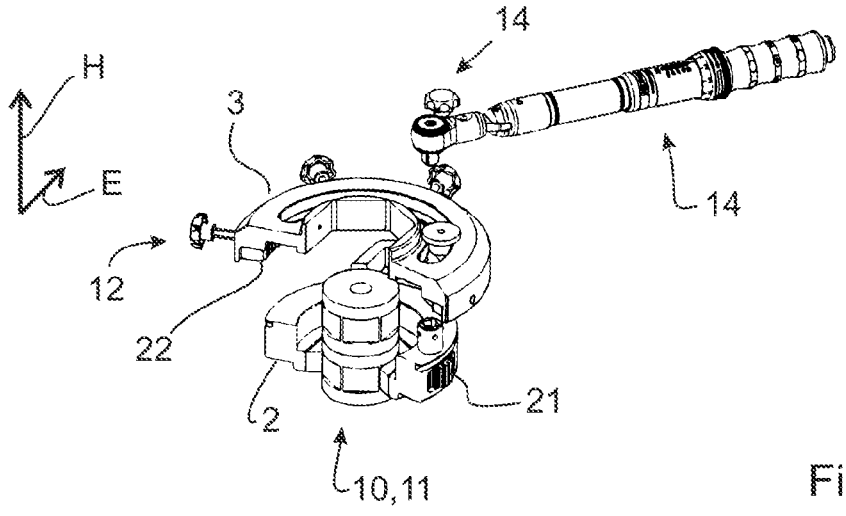

FIG. 5 schematically illustrates the screwing device 1 of the exemplary embodiment of FIGS. 1 to 4 in a perspective partial exploded view with the operating element 14 and the screwed-together fastening elements 10, 11. The same reference numerals are used for elements that correspond in function and/or structure to the elements of FIGS. 1 to 4. The tool 3 is moved away from the tool 2 in the height direction H, so that the drive gear wheel 21 and the driven gear wheel 22 are visible. The safety elements 12, 13 are pulled out from the tools 2, 3 at least far enough so that the tool 3 can be detached from the tool 2.

Figure 6:
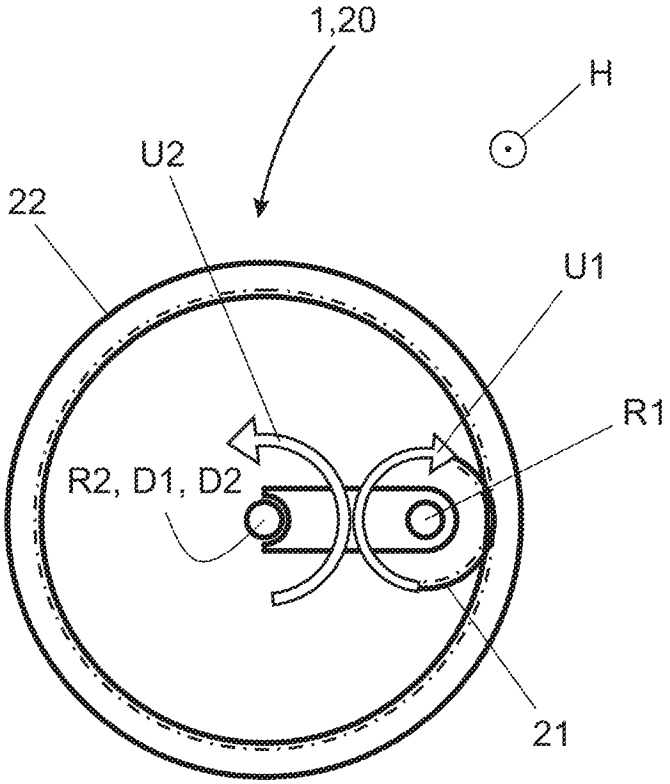
FIG. 6 a schematic plan view of the screwing device of the exemplary embodiment of FIGS. 1 to 5.

FIG. 6 schematically illustrates the screwing device 1 of the exemplary embodiment of FIGS. 1 to 5 in a plan view, wherein the screwing device 1 is shown essentially reduced to the gear 20. The same reference numerals are used for elements that correspond in function and/or structure to the elements of FIGS. 1 to 5.

The gear 20 is shown with the drive gear wheel 21 and the driven gear wheel 22 formed as a ring gear. An axis of rotation R1 of the drive gear wheel 21 and an axis of rotation R2 of the driven gear wheel 22 point out of the drawing plane and extend parallel to the height direction H. The axis of rotation R2 is hereby aligned with mutually overlapping axes of rotation D1, D2 of the tools 2, 3 and/or the receptacles 4, 5, respectively.

When an operating force is introduced into the drive gear wheel 21, thereby rotating the drive gear wheel 21, for example, in a clockwise rotation direction U1, then the driven gear wheel 22 is rotated in another direction of rotation U2 due to the tooth engagement of the drive gear 21 and the driven gear 22, with the directions of rotation U1, U2 being opposite directions.

The driven gear wheel 22 formed as a ring gear is attached to the base body 16 of the tool 3 formed as a gear wheel carrier and rotates with the base body 16 about the axis of rotation D2. The drive gear wheel 21 rotates in the base body 15 of the tool 2, in which it is rotatably mounted.

Figure 7:
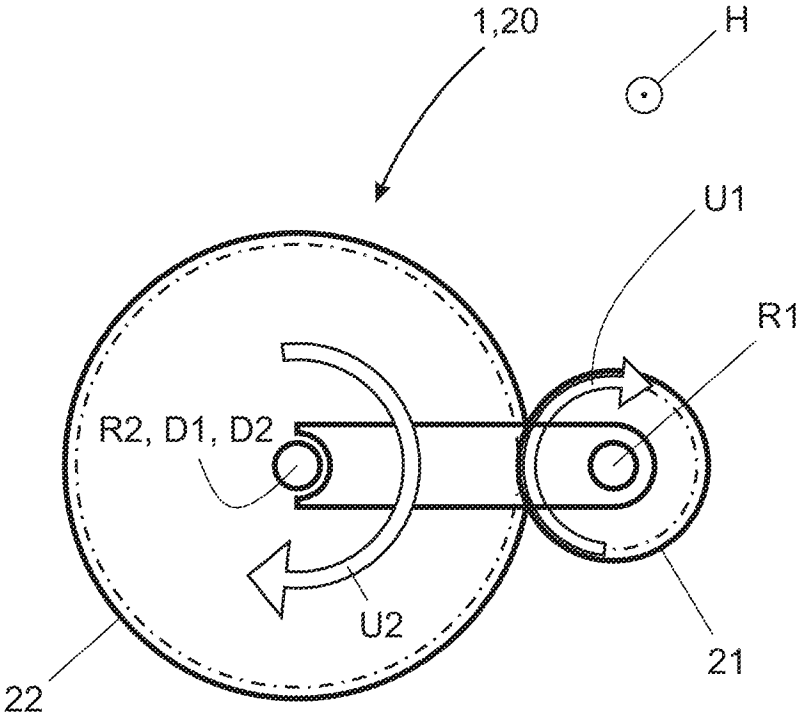
FIG. 7 another exemplary embodiment of the screwing device according to the invention in a schematic plan view.

FIG. 7 illustrates schematically another exemplary embodiment of the screwing device 1 according to the invention in a plan view opposite to the height direction H, wherein the screwing device 1 is shown essentially reduced to the gear 20. The same reference numerals are used for elements that correspond in function and/or structure to the elements of FIGS. 1 to 6. For brevity, only the differences to the exemplary embodiment of FIGS. 1 through 6 are described below.

The gear 20 includes the drive gear wheel 21, which substantially corresponds to the drive gear wheel 21 of the exemplary embodiment of FIGS. 1 to 6. However, the driven gear wheel 22 of the exemplary embodiment of FIG. 7 is formed not as a ring gear, but rather as a regular toot

The invention claimed is:

1. A screwing device comprising at least two tools, each having a receptacle for a screwable fastening element, wherein during operation of the screwing device each receptacle is arranged with mutually aligned axes of rotation and spaced apart along the mutually aligned axes of rotation, wherein the at least two tools are connected to one another during the operation of the screwing device for rotation about the mutually aligned axes of rotation, further comprising a gear which rotatably connects the at least two tools to one another, wherein the gear is a toothed gear, wherein a respective gear wheel of the gear is associated with each of the at least two tools.

2. The screwing device according to claim 1, wherein the at least two tools are separable from one another along the mutually aligned axes of rotation.

3. A screwing device comprising at least two tools, each having a receptacle for a screwable fastening element, wherein during operation of the screwing device each receptacle is arranged with mutually aligned axes of rotation and spaced apart along the mutually aligned axes of rotation, wherein the at least two tools are connected to one another during the operation of the screwing device for rotation about the mutually aligned axes of rotation, further comprising a gear which rotatably connects the at least two tools to one another, wherein the gear comprises a drive gear wheel and an driven gear wheel which are motion-coupled with one another, wherein the drive gear wheel is rotatably mounted on one of the at least two tools and the driven gear wheel is attached to another one of the at least two tools.

4. The screwing device according to claim 3, wherein a rotation axis of the drive gear wheel is aligned parallel to and spaced from the mutually aligned axes of rotation.

5. The screwing device according to claim 3, wherein an axis of rotation of the driven gear wheel is in alignment with the mutually aligned axes of rotation.

6. The screwing device according to claim 3, wherein the driven gear wheel is a ring gear.

7. The screwing device according to claim 3, wherein the drive gear wheel comprises a coupling member for coupling with an operating element.

8. The screwing device according to claim 3, wherein the at least two tools are separable from one another along the mutually aligned axes of rotation.

9. A screwing device comprising at least two tools, each having a receptacle for a screwable fastening element, wherein during operation of the screwing device each receptacle is arranged with mutually aligned axes of rotation and spaced apart along the mutually aligned axes of rotation, wherein the at least two tools are connected to one another during the operation of the screwing device for rotation about the mutually aligned axes of rotation, wherein the screwing device further comprises at least two connecting elements, which are each connectable to one of the receptacles and which, when attached on the receptacle, are held so as to be prevented from rotating about the mutually aligned axes of rotation relative to a base body of the respective tool.

10. The screwing device according to claim 9, wherein the at least two tools are separable from one another along the mutually aligned axes of rotation.

* * * * *